United States Patent [19]

Jones

[11] Patent Number: 4,838,366

[45] Date of Patent: Jun. 13, 1989

[54] DRILL BIT

[76] Inventor: A. Raymond Jones, 11431-A Ferrell Dr., Dallas, Tex. 75234

[21] Appl. No.: 238,335

[22] Filed: Aug. 30, 1988

[51] Int. Cl.[4] ..... E21B 10/42; E21B 10/46

[52] U.S. Cl. ..... 175/410; 175/411; 175/413

[58] Field of Search ..... 175/412, 413, 410, 411, 175/409, 379, 382, 384

[56] References Cited

U.S. PATENT DOCUMENTS

| | | | |
|---|---|---|---|
| 1,557,743 | 10/1925 | Terrill | 175/412 |
| 2,604,305 | 7/1952 | Livingstone | 175/413 X |
| 2,861,779 | 11/1958 | White | 175/412 |
| 3,106,973 | 10/1963 | Christensen | 175/410 X |
| 3,463,256 | 8/1969 | White | 175/412 |
| 3,545,554 | 12/1970 | Bardwell | 175/412 X |
| 3,672,455 | 6/1972 | Foster, Jr. | 175/412 |
| 4,026,372 | 5/1977 | Hampson | 175/410 |
| 4,252,202 | 2/1981 | Purser, Sr. | 175/412 |

*Primary Examiner*—Stephen J. Novosad

*Attorney, Agent, or Firm*—Johnson & Swanson

[57] ABSTRACT

A drill bit for drilling holes in earth formations including a bit body having an integral shank for connection to a drilling machine stem and integral radial mounting wings for supporting removable cutter blades, and a removable cutter blade secured on each wing, each cutter blade having a tungsten carbide front drilling face arranged at a negative rake angle and an outside side face having a forward cutting edge of tungsten carbide and a relieve angle extending rearwardly and inwardly toward the axis of the bit for minimizing the mass of the bit exposed to the bore hole wall during drilling for reducing the temperature of bit. The bit has a longitudinal bore and lateral angular bores for air drilling fluid.

16 Claims, 2 Drawing Sheets

DRILL BIT

BACKGROUND OF THE INVENTION

1. Field of the Invention

This invention relates to drill bits, and more particularly relates to drill bits having removable cutter blades having hardened cutting surfaces and especially adapted for drilling earth formations, including limestone, sandstone, and shale.

BACKGROUND OF INVENTION

Earth formations are drilled using both rotary and percussion drilling machines. Rotary machines rotate a bit while applying pressure to the drill stem of the bit to advance the bit as chips are removed by the bit cutting surfaces. In rotary drilling, drill bits often include rotatable cone shaped cutting members. In percussion drilling, the drilling machine reciprocates the drill bit and sometimes rotates the bit as a hole is formed.

2. History of the Prior Art

U.S. Pat. No. 2,101,864, to W. J. McCallum, shows a percussion type drill bit having removable cutting nibs 11 which are formed of a material which is harder than the body of the bit. The nibs are replaceable when worn.

U.S. Pat. No. 2,166,478, to R. N. Riblet, shows a percussion type drill bit having replaceable cutters 1, 2, 3, and 4.

U.S. Pat. No. 2,215,948, to P. A. Williams, shows a percussion type drill bit having replaceable cutting elements.

U.S. Pat. No. 2,252,745, to H. E. Williams, shows a percussion type drill bit having replaceable blades which fit in grooves in the drill bit head.

U.S. Pat. No. 2,604,305, to J. Livingstone, shows a percussion type drill bit having detachable cutting elements which uses a dovetail shaped lug fitting a recess in the body of the drill bit and an abutment 38 controlling the lateral positioning of the insert element.

U.S. Pat. No. 3,434,552, to A. B. Bower, Jr., shows a drill bit for drilling holes for mine roof bolts having a head and a single transverse cutting element 20 positioned in a transverse groove in the head, held in position by a wire pin 25. The cutter insert is made of a hard material, such as tungsten carbide.

U.S. Pat. No. 4,446,936, shows a drill bit for drilling holes for roof bolts in mines which has a head and a removable cutter which may be replaced when worn. The cutter is loosely held in position by a pin 89.

None of the prior art patents cited above and known to Applicant disclose rotary type drill bits having removable inserts with hardened cutting edges along both the end and side cutting edges and having the construction and configuration of the drill bit of the present invention. Further, the drill bits of the types illustrated in the foregoing patents are substantially less efficient and penetrate at a significantly lower rate than the bit of the invention.

SUMMARY OF THE INVENTION

In accordance with the present invention, there is provided a rotary type drill bit that is particularly adapted to drilling soft earth formations, such as limestone, sandstone, and shale, at a significantly improved rate over both tri-cone drill bits and percussion type drill bits presently available.

It is a principal object of the invention to provide a new and improved rotary drill bit.

It is another object of the invention to provide a rotary type drill bit which removes large chips of earth formations which are lifted to the surface by air.

It is another object of the invention to provide a rotary type drill bit which has removable and replaceable cutter blades.

It is another object of the invention to provide a drill bit of the character described which uses removable cutter blades having hardened cutting faces and end and side cutting edges.

It is another object of the invention to provide a rotary type drill bit having removable cutter blades which have cutting faces provided with a negative rake for removing large chips while cutting.

It is another object of the invention to provide a rotary type drill bit having relieved side trailing surfaces minimizing the contact of the cutters with the hole wall being cut reducing the temperature of the bit during drilling.

It is another object of the invention to provide a rotary type drill bit having cutting faces each aligned with a radius line drawn to the longitudinal axis of the drill bit body.

It is another object of the invention to provide a rotary type drill bit having a body provided with radial wings having cutter blade mounting slots and removable cutter blades each having a mounting tongue shaped to engage a slot in the mounting wing and roll pin holes in the cutter blade tongues and the mounting wings intersecting the slots in wings for mounting the cutter blades on the wings held in place by roll pins.

In accordance with the invention there is provided a rotary type drill bit having a body provided a shank for connection with a rotary drilling machine and circumferentially spaced radial cutter blade mounting wings and a removable cutter blade sized and shaped for mounting on each of the wings, each of the cutter blades having a cutting face, end cutting edges, and side cutting edges formed of a material substantially harder than the remainder of the cutter blade and drill bit body.

BRIEF DESCRIPTION OF THE DRAWING

The foregoing objects and advantages of the drill bit of the invention will be better understood from the following detailed description taken in conjunction with the accompanying drawings wherein.

DETAILED DESCRIPTION OF THE PREFERRED EMBODIMENT

Figure 1:
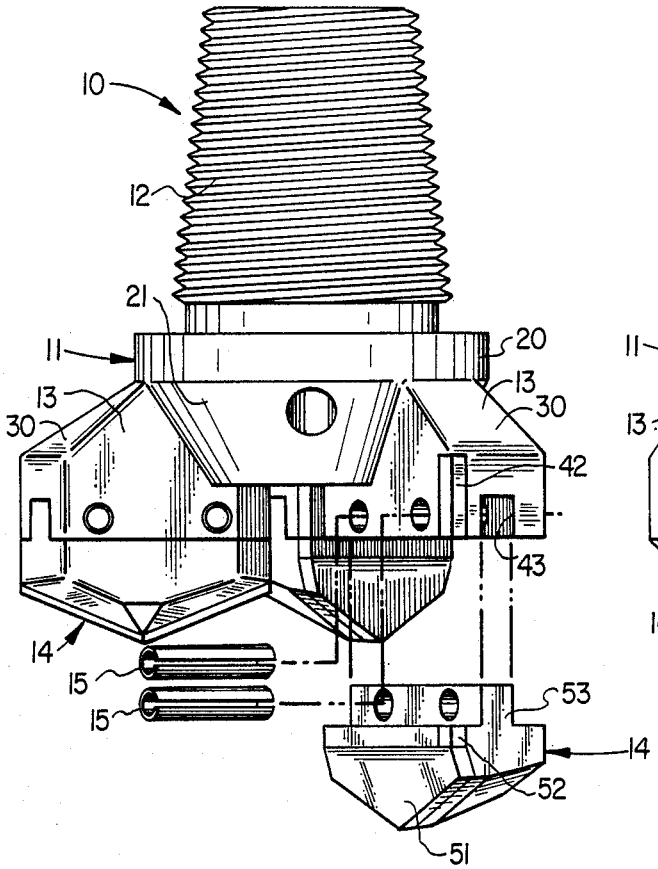
FIG. 1 is side view in perspective of the drill bit of the invention with one of the cutter blades exploded out to illustrate the relation of the cutter blade and a wing of the body.

Referring to the drawings, a drill bit 10 embodying the features of the invention includes a body 11, an integral shank 12 for connection to a drilling machine, integral cutter blade mounting wings 13, and removable cutter blades 14 which are held in operating positions on the wings by roll pins 15. The cutter blades and wings are provided with hardened material over the cutting faces and the cutting edges of both the removable cutter blades and the supporting wings. The drill bit is particularly adapted for improved drilling in softer rook formations, such as soft limestone, sandstone, and shale. Typically, for most drilling applications, the bits are made in size ranges of from 3 inches to 5 inches diameter. Also, typically, three wings and cutter blades are employed.

Figure 2:
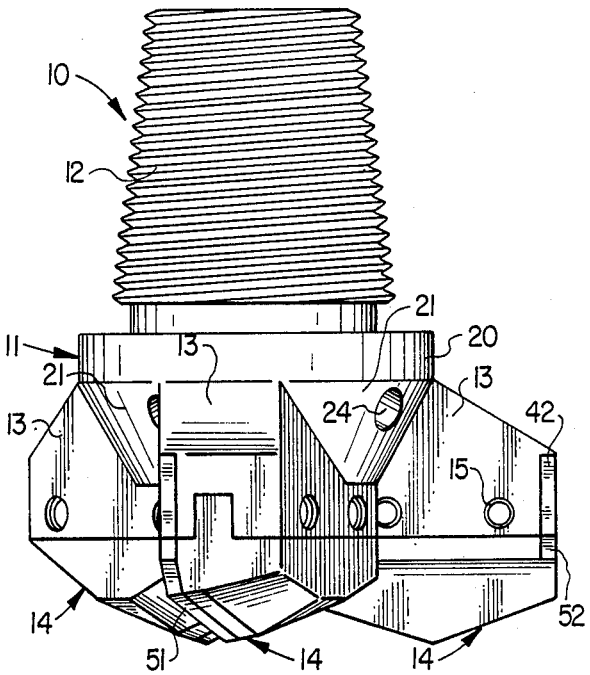
FIG. 2 is a side view in perspective of the drill bit of FIG. 1 rotated from the position of the bit in FIG. 1.
Figure 4:
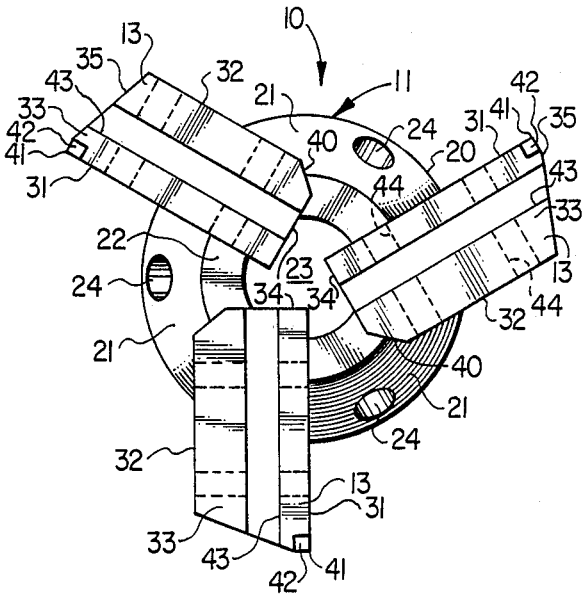
FIG. 4 is a bottom view of the drill bit body and wings with the cutter blades removed.
Figure 5:
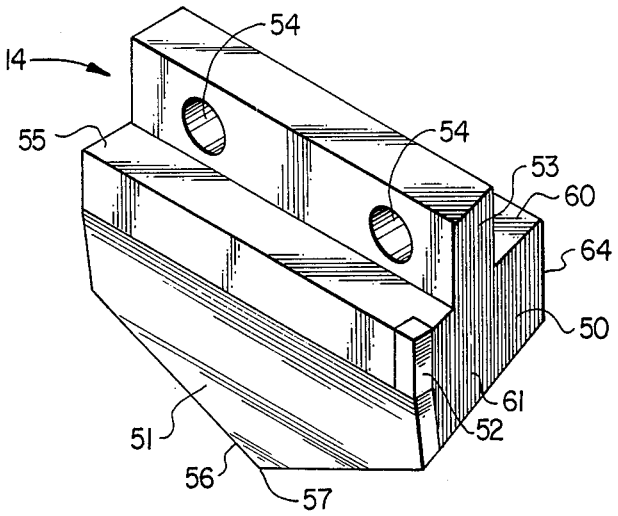
FIG. 5 is a top side view in perspective of one of the cutter blades of the drill bit.

Referring to FIGS. 1 and 2, the shank 12 is tapered and externally threaded for securing to a drill stem of a drilling machine, not shown. It will be recognized, of course, that the shank 12 may be of uniform diameter or may have other configurations and shapes, depending upon the structure of the chuck or drill stem of the drilling machine. As illustrated in FIGS. 1, 2, and 4, the body 11 has a central cylindrical portion 20 and a lower somewhat conical portion defined by downwardly and inwardly convergent side surfaces 21 terminating at a lower end 22 of the bit body between the wings 13. The bit body has a longitudinal bore 23 extending throughout the length of the body opening through the upper end of the body and through lower end, as evident in FIG. 4, to permit a sufficient volume of drilling fluid, such as air to flow through the body. The lower conical portion of the bit body has upwardly and inwardly extending flow passages 24 which open at lower ends through the side faces 21 and intersect at upper ends with the body bore 23 for conducting drilling fluid from the central bore 23 downwardly and outwardly between wings and the cutter blades during drilling.

Figure 3:
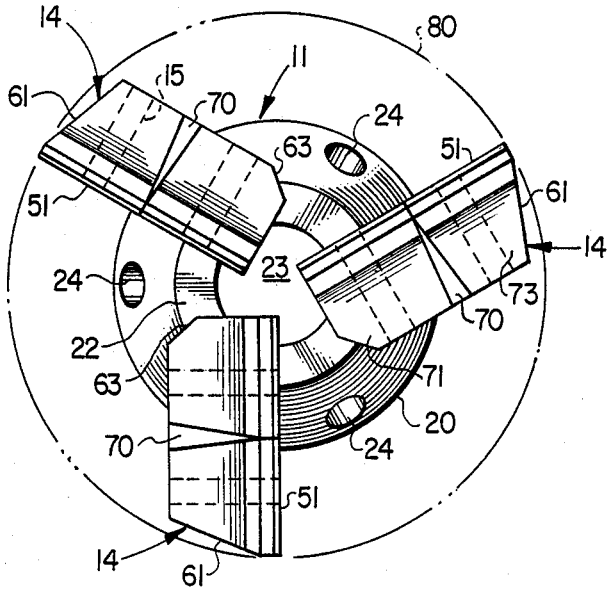
FIG. 3 is a bottom view of the drill bit of FIGS. 1 and 2 with a broken line representation of the wall of a hole cut with the bit.

As shown in FIGS. 2, and 4, the cutter blade support wings 13 are formed integral with the lower portion of the body extending downwardly and radially outwardly, as illustrated, with reference to the drilling position of the bit. As best seen in FIG. 4, the three wings are spaced apart at 120 degree angles around the bit body. Each wing has a top face 30, a forward face 31, defined in terms of the directions of rotation of the bit, a back face 32, a bottom face 33, an inside side face 34, and an outside side face 35. An inside back corner face 40 extends between the inside side face 34 and the back face 32. The front face 31, as seen in FIG. 4, lies in a plane which is vertical as illustrated in the drawings and which is parallel with the longitudinal axis of the bit body, that is the axis through the center of the bore 23, and also is a plane which includes a radius line, not shown, extending to and perpendicular to the longitudinal axis of the body. The outside side face 35 of each of the wings is a relieved face which slopes inwardly toward the bit body axis and rearwardly from the front face 31 to the back face 32 so that, as best seen in FIG. 3, as the bit rotates the side face does not engage the wall of the drill hole being cut. Each cutter blade support wing 13 has an outside side and front vertical cutting edge 41 on a rectangular insert 42 which is preferably formed of tungsten carbide, welded into the front outer vertical corner of the wing at the juncture of the front face 31 and the outer side face 35, defining a vertical side cutting edge 41. The bottom face of each of the wings 13 as seen in FIG. 4 has a mounting recess extending the length of the wing opening through the bottom face 33 of the wing aligned parallel to the front face 31 and having a rectangular cross section, as evident in FIGS. 1 and 2. The flat face 33 on each side of the mounting recess 43 provides a seat or bearing surface for the cutter blade 14 mounted on the wing. Lateral roll pin holes 44 are formed in each of the wings, intersecting the mounting slot 43, to receive the roll pins 15 for holding the removable cutter blades on the wings 13. The relief angle of the side surfaces 35 of the wings is sufficient to insure that the sides of the wings are away from the wall of the bore hole being cut so that the bit does not unduly heat during drilling. Preferably this angle is about 30° degrees. The material forming the bit body including the central portion 20, the wings 13, and the shank 12, is preferably forged or cast steel having a 41–40 analysis. The insert in each wing providing the vertical side cutting edge 41 is preferably a mine grade tungsten carbide induction heat welded to the wing.

Figure 6:
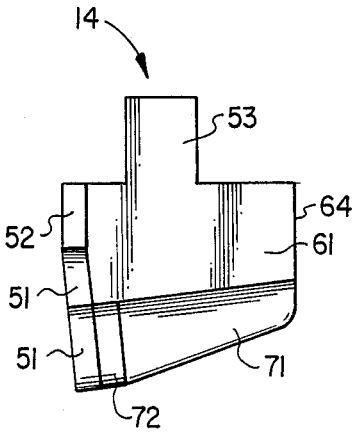
FIG. 6 is an outside side view of the cutter blades.
Figure 7:
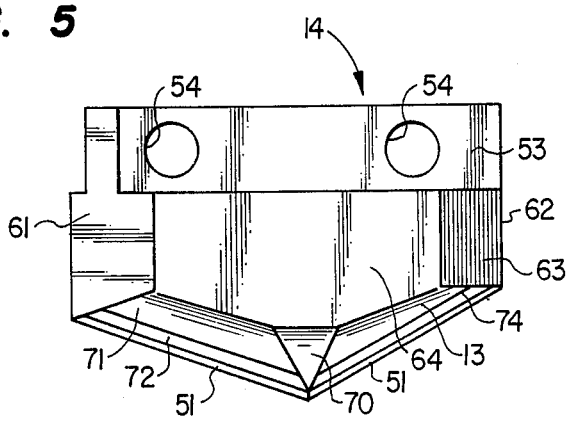
FIG. 7 is a back view of the cutter blades.
Figure 8:
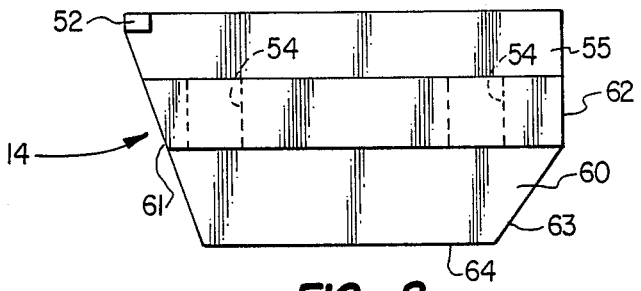
FIG. 8 is a top view of the cutter blade.
Figure 9:
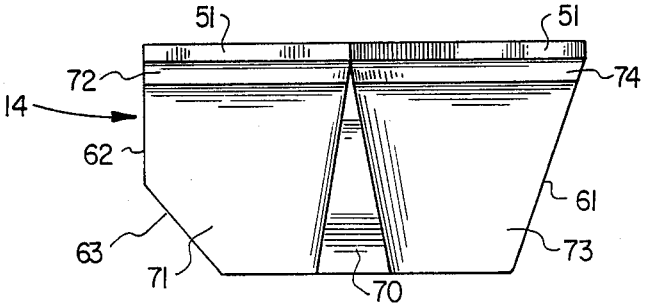
FIG. 9 is a bottom view of the cutter blade.

The removable cutter blades 14 are illustrated in detail in FIGS. 5–9. The removable cutter blade has a body 50 to which is secured a hardened cutting face insert 51 and an outside vertical side edge insert 52, both formed of a suitable material, such as mining grade tungsten carbide, induction heat welded to the cutter blade body. The cutter blade has a mounting tongue 53 which is an integral part of the body 50 extending across the full length of the top of the body and is rectangular in cross section as evident in FIGS. 5 and 6. The mounting tongue has spaced lateral roll pin holes 54 sized to receive the roll pins 15 extending through the roll pin holes 44 in the wings 13. The top surfaces of the cutter blade body 50 on either side of the tongue 53, defined by the seat surfaces 55 and 60, are sized to engage the top surfaces of the wing 13 on either side of the wing slot 43 on which the cutter blade is mounted. The outside side face 61 is relieved, or tapers inwardly, as evident in FIGS. 3, 8, and 9, and is aligned in the same plane as the side face 35 of the wing on which the cutter blade is mounted. The corner carbide insert 52 is aligned with the corner carbide insert 42 of the wing on which the cutter blade is mounted providing a forward side cutting edge the full height of the wing and cutter blade mounted thereon so that as each wing and cutter blade rotates during drilling, the outside forward edge of the wing and cutter blade forms a cutting edge cutting the wall of the hole being drilled. The front cutting face carbide insert 51 is positioned at a negative rake angle, preferably about 7.5° degrees, as previously discussed and clearly shown in FIG. 6. The rake angle of the insert 51 slopes backwardly and downwardly relative to the direction of rotation of the drill bit to push cuttings ahead of and downwardly from the cutter blade as the bit rotates. The bottom edge of the insert 51 is a V-shaped cutting edge 56 having an apex 57. The cutter blade body has an inside side face 62 and a contiguous backside face 63, which are aligned with the side and back corner faces 34 and 40 of the wing 13 when the cutter blade is mounted on the wing. The cutter blade body has a back face 64, FIG. 7. The bottom of the cutter blade body and carbide insert 51, as seen in FIGS. 6, 7, and 9, is somewhat contoured being defined by a central rectangular, somewhat flat, surface 70, side surfaces 71, 72, on one side of the central surface 70, and surfaces 73, and 74 on the other side of the surface 70, such surfaces sloping together to the central surface 70 providing a V-shaped configuration to the bottom of the cutter blade body as evident in FIG. 7.

The body 50 of the removable cutter blades may be cast or forged of the same material as the bit body 11. The tungsten carbide inserts 51 and 52 on the face and the outer side edge of the removable cutter blades covers only a portion of the forward cutting surface of the cutter blade because of the high cost of the tungsten carbide. It will be evident that if cost is not a factor in bit construction, the front cutting face of the entire cutter blade could be covered with tungsten carbide. The principal required features of each cutter blade, in accordance with the invention, is the forming of the major portion of the cutting face and the outside side face of the cutter blade with the inserts 51 and 52 with the insert 51 being positioned at the negative rake angle for improved cutting removal and the relief of the side face 61 which slopes inwardly and rearwardly to minimize engagement of the blade with the bore wall during cutting to keep the temperature of the bit down. The other features of the cutter blade may be modified consistent with providing sufficient mass in the cutter blade body for the support of the tungsten carbide inserts, and to withstand the cutting forces involved during drilling. Thus, the configuration of the inside side faces defined by the surfaces 62 and 63 as well as the configuration of the generally V-shaped bottom of the cutter blade as seen FIGS. 7 and 9, may be somewhat varied as desired. For example, such surfaces can be curved or contoured surfaces, rather than a composite of flat planer surfaces as illustrated.

The cutter blades 14 are each mounted on the wings 13 of the bit body as illustrated in FIGS. 1, 2, and 3. Each cutter blade body is placed on a wing with the cutter blade tongue 53 positioned in the wings slot 43, holes 54 in the cutter blade tongue being aligned with the holes 44 of each wing. The seat surfaces 55 and 60 on opposite sides of the cutter blade tongue rest against the bottom seat surfaces 33 on opposite sides of the wing slot 43 so that downward forces on the bit body during drilling as well as upward reaction forces against the cutter blade are fully transmitted and absorbed respectively by the contacting seat surfaces of the wings and cutter blade bodies. As is well known with roll pins, the pins are slightly larger the holes in the wings and cutter blade tongues so that when the roll pins are inserted they are slightly compressed to provide a tight fit, holding each cutter blade tongue in each slot of each of the wings. The bit is secured with the drilling machine stem, not shown, by means of the threaded shank 12. The bit is rotated counterclockwise as viewed from below the bit as seen in FIG. 3, drilling a hole in earth formations, defined by the broken line 80 in FIG. 3. As the drill is rotated and advanced in the earth formation, the outside side cutting edges on the drill bit wings and cutter blades defined by the tungsten carbide corner inserts 42 and 52, cuts the side wall of the hole determining the gauge of hole while the mass of the material within the hole is removed by the rotating and advancing cutter blade inserts 51. The Vshaped lower cutting edge 56 with the apex 57 aids in advancing the bit into the formation being cut. Drilling fluids, such particularly as air, is forced under high pressure down the drill stem through the central bore 23 and outwardly against the formation being cut through the open lower end of the central bore and through the connecting side bores 24. The air flows outwardly around the advancing bit and upwardly in the bore hole along the bit sides and the drill stem lifting the cuttings from the hole being drilled.

It will be evident from the forgoing description and drawings that a new and improved drill bit for earth formation boring has been described and illustrated. The cutter blades may be removed and replaced thereby saving the added cost of a new bit body and reducing the number of bit bodies required to be kept in stock.

What is claimed is:

1. A drill bit comprising:

a body;

means on said body for securing said bit to a drill stem for rotating and advancing said bit;

radial cutting blade support wings on said body circumferentially spaced around and extending radially outwardly from said body each of said wings being provided with a slot aligned substantially parallel to a radius line drawn to the longitudinal axis of said body perpendicular to said longitudinal axis;

a cutting blade removably mounted on each of said wings, each said blade having integral end cutting edges and peripheral side cutting edges and a major portion of the cutting face of each said blade formed of a material different from and substantially harder than the remainder of each said blade, each said cutting blade having a mounting tongue formed along said blade on the opposite end of said blade from said end cutting edge and shaped to fit said slot in said wing, each said wing and said blade mounted on said wing having at least one transverse hole in registry; and a roll pin through said hole in said blade tongue and said wing retaining said blade in said wing.

2. A drill bit in accordance with claim 1 wherein the front cutting face of each said blade covered by said hardened material lies in a plane having a negative rake angle relative to the cutting direction of rotation of said blades.

3. A drill bit in accordance with claim 2 wherein the outside side face of each of said blades is relieved in a direction away from the direction of rotation from the side cutting edge of each of said blades to minimize the heat generation in said bit while drilling.

4. A drill bit in accordance with claim 3 wherein the forward side edge of each of said wings has a hardened side edge of a material harder than said body and contiguous with said hardened side edge of said blade secured with said wing.

5. A drill bit in accordance with claim 4 wherein said end cutting edge of said blade is defined by downwardly convergent edges joined at a central apex.

6. A drill bit in accordance with claim 5 wherein said hardened end and side edges of said blade and said hardened forward side edge of said wing are formed of tungsten carbide induction heat welded to said blade and said wing of said body.

7. A drill bit in accordance with claim 6 wherein said bit body has a central bore extending through the said body and connecting bores intersecting said central bore opening downwardly and outwardly through said body between adjacent side edges of said wings.

8. A drill bit in accordance with claim 7 including three of said wings and three of said blades each supported on one of said wings spaced at 120 degree angles around said body.

9. A drill bit in accordance with claim 8 wherein the upper edge of said hardened face on each of said blades defines a radius line of said bit intersecting the longitudinal axis of said bit when said inserts are installed in said bit body.

10. A drill bit in accordance with claim 9 wherein each of said slots in each of said wings is rectangular in cross section and said tongue on each of said inserts engaging said groove in said wing is rectangular in cross section.

11. A drill bit in accordance with claim 10 where each of said inserts has a rectangular bearing surface on each side of side of said tongue and each of said wings has a rectangular bearing surface on each side of said groove engageable by said tongue bearing surfaces for maximizing load distribution between said inserts and said body during drilling.

12. A drill bit in accordance with claim 11 wherein said shank of said body is threaded for engagement with the stem of a rotary drill.

13. A drill bit for drilling earth formations comprising:

a drill bit body having an integral shank portion for connection with a drilling machine stem and plurality of circumferentially spaced radially outwardly extending integral cutter blades support wings, each said wing having a forward face in the direction of rotation of said bit positioned in a plane parallel with the longitudinal axis of said bit body and containing a radius line from said longitudinal axis, each said wing having a bottom face in a plane perpendicular to the longitudinal axis of said bit body and a mounting groove formed in said bottom face extending the length of said wing parallel with said front face of said wing, spaced lateral roll pin holes through said wing from the front face thereof intersecting said mounting groove, and said wing having an outside side face positioned at a relief angle sloping rearwardly from said front face of said wing inwardly from the cutting path of said wing and a cutter blade mounted in said wing for minimizing the mass of said bit engaging the wall of a hole drilled by said bit as said bit rotates, and a tungsten carbide insert induction welded into said front face along said outside side face of each said wing providing a forward side cutting edge on said wing at the forward edge of said relieved side face;

said drill bit body having a longitudinal bore along the longitudinal axis of said body opening through opposite ends of said body and downwardly and outwardly sloping drilling fluid flow passages intersecting said central bore and opening downwardly and outwardly through said bit body between said integral wings; and a removable cutter blade mounted on each of said wings, each said cutter blade having a body provided with a mounting tongue sized and shaped to engage said mounting recess of said wing and having seat surfaces along opposite sides of said tongue engageable with the bottom surface of said wing on opposite sides of said mounting recess of said wing, said tongue having spaced roll pin holes aligned with said roll pin hole in said wing when said tongue is in said recess of said wing, each said cutter blade body having an outside side relieved surface aligned with said relieved side surface of said wing when said cutter blade is mounted on said wing, a tungsten carbide insert mounted across a major portion of the forward face of said cutter blade, said carbide insert having a forward cutting face aligned at a negative rake angle sloping downwardly and rearwardly relative to the direction of rotation of said bit, said carbide insert on the forward face of said cutter blade having a lower V-shaped cutting edge and a vertical side forward cutting edge, and a second tungsten carbide insert in the forward face of said cutter blade at the outside edge of said cutter blade forming a forward side vertical cutting edge on said cutter blade aligned with said forward side outside cutting edge on said wing when said cutter blade is mounted on said wing; and a roll pin through each roll pin hole in each removable cutter blade and through said holes in said wings holding said cutter blades on said wings.

14. A drill bit in accordance with claim 13 including three cutter blade mounting wings on said drill bit body at 120 degree spacing around said body and one said cutter blade mounted on each of said wings.

15. A drill bit in accordance with claim 14 wherein said drill bit body has a central substantially cylindrical portion and a downwardly tapered somewhat conical lower portion and each of said cutter blades has a substantially V-shaped bottom face.

16. A drill bit comprising:

a body;

means on said body for securing said bit to a drill stem for rotating and advancing said bit;

radial cutting blade support wings on said body circumferentially spaced around and extending radially outwardly from said body, each said wing having a bottom face in a plane perpendicular to the longitudinal axis of said bit body and a mounting slot formed in said bottom face extending the length of said wing, said bottom face on each side of said slot being a bearing surface for axial and torque loads on said bit body when drilling; and a cutting blade removably mounted on each of said wings, said cutting blade having integral end cutting edges and peripheral side cutting edges formed of a material different from and substantially harder than the remainder of said blade and said cutting blade having a mounting tongue sized and shaped to engage said mounting slot of said wing and seat surfaces along opposite sides of said tongue engageable with said surfaces on said wing on opposite sides of said slots defining load bearing surfaces on each said blade for axial and torque forces between each said blade and each said wing during drilling.

* * * * *